United States Patent [19]

Ennerdal et al.

[11] 4,266,325

[45] May 12, 1981

[54] SAFETY BELT FOR VEHICLES

[75] Inventors: Leif Ennerdal, Alingsas; Lars E. Berg, Vargarda, both of Sweden

[73] Assignee: Autoliv AB, Vargarda, Sweden

[21] Appl. No.: 24,572

[22] Filed: Mar. 28, 1979

Related U.S. Application Data

[63] Continuation of Ser. No. 815,268, Jul. 13, 1977, abandoned.

[30] Foreign Application Priority Data

Jul. 19, 1976 [SE] Sweden ..... 7608200

[51] Int. Cl.[3] ..... A44B 11/26

[52] U.S. Cl. ..... 24/230 A; 24/230 AL

[58] Field of Search ..... 24/230 A, 230 BC, 230 AL, 24/230 R

[56] References Cited

U.S. PATENT DOCUMENTS

| | | | |
|---|---|---|---|
| 3,340,578 | 9/1967 | Straight et al. | 24/196 |
| 3,450,434 | 6/1969 | Schock | 24/230 AL |
| 3,825,979 | 7/1974 | Dakob | 24/230 A |
| 3,955,056 | 5/1976 | Lindblad | 24/230 A |
| 4,004,115 | 1/1977 | Esner | 24/230 AL |
| 4,033,015 | 7/1977 | Uwe et al. | 24/230 AL |
| 4,069,557 | 1/1978 | Loomba | 24/230 AL |

FOREIGN PATENT DOCUMENTS

| | | | |
|---|---|---|---|
| 2341601 | 2/1975 | Fed. Rep. of Germany | 24/230 A |

*Primary Examiner*—Alexander Grosz

[57] ABSTRACT

A receiving part for a safety belt for vehicles, wherein the band of the safety belt has a disc shaped coupling tongue which can be introduced in between two disc shaped guiding plates, and wherein the receiving part has a locking body, which, when the coupling tongue and the receiving part are coupled together, holds the coupling tongue and moreover is movable in a direction transverse to the guiding plates. A wedge shaped operating member is displaceable along the outside of at least one of the guiding plates with the wedge angle of the operating member being formed between the outside of the guiding plate and a side of the operating member facing away from the same, the locking body having shoulders, which extend along the outside of the guiding plate and which rest on the outer wedge side of the operating member with supporting or sliding surfaces extended in the direction of movement of the operating member.

4 Claims, 4 Drawing Figures

SAFETY BELT FOR VEHICLES

This is a continuation, of application Ser. No. 815,268, filed July 13, 1977, now abandoned.

The present invention relates to safety belts for vehicles, more particularly a receiving part intended to form part of a coupling means of a safety belt for vehicles, where the band of the safety belt supports a disc shaped coupling tongue, which is intended at the time of putting on the safety belt to be received and held in said receiving part, and in which the coupling tongue can be introduced in the receving part in the interspace between two guiding surfaces preferably formed by disc shaped guiding plates or the like, the distance between said surfaces somewhat exceeding the thickness of the locking tongue, and the receiving part having a locking body, which, when the locking tongue and the receiving part are coupled together in between them, holds the coupling tongue and moreover is movable in a direction transverse to the guiding plates, said locking body by means of said movement being arranged to be introduced into and removed from engagement with the coupling tongue behind a stop provided on the same.

It is a principal object of the invention to provide a coupling means, which is easy to operate and of simple design, which coupling means makes possible the operation of the locking body without lateral friction forces affecting the same.

This object is reached by means of the invention, which substantially is characterized by the receiving part comprising a wedge shaped operating member, which is displaceable along the outside of at least one of the guiding plates, the wedge angle of said operating member being formed between the outside of the guiding plate and a side of the operating member facing away from the same, the locking body in addition having shoulders, which project in lateral direction, i.e. extend along the outside of the guiding plate in question, which shoulders rest on the outer wedge side of the operating member with supporting or sliding surfaces extending in the direction of movement of the operating member.

Figure 4:
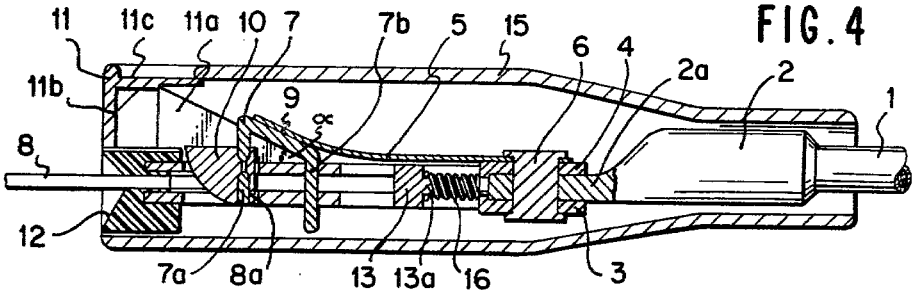
Figure 1:
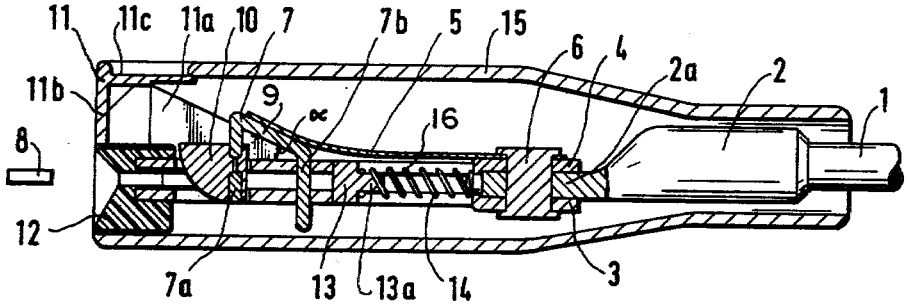
Figure 2:
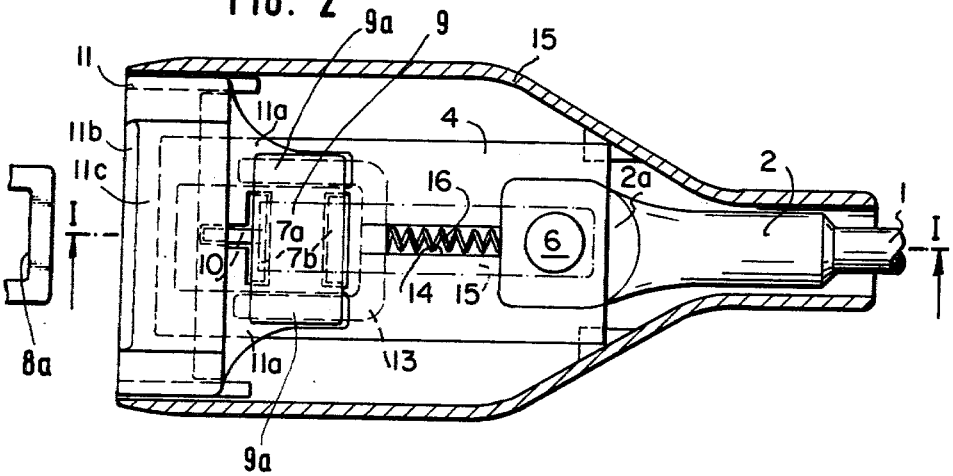
Figure 3:
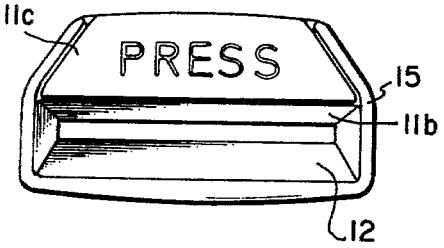

An embodiment of the invention is described in the following, reference being made to the accompanying drawing, in which FIG. 1 illustrates a longitudinal cross section through a receiving part according to the invention, FIG. 2 shows a cross section of the receiving part at right angle to the cross section shown in FIG. 1, FIG. 3 is a view of the same receiving part as seen from the left according to the FIGS. 1 and 2, and FIG. 4 shows the receiving part of FIG. 1 with the coupling tongue of the seat belt inserted.

The receiving part illustrated in the drawing is intended to be anchored suitably to the body of the vehicle by means of a flexible wire 1, on the end of which a ferrule 2 is press fitted, said ferrule at its extreme end having a flatten end portion 2*a*. Against opposite sides of the flattened end portion of the ferrule guiding plates 3 and 4 respectively rest, which together with a plate spring 5 extending along one guiding plate 4 is held in a clamped position to the terminal ferrule 2 by means of a through rivet 6. A locking body, which is movable in crosswise direction to the guiding plates 3, 4, is indicated with 7, said locking body in the cross section illustrated in FIG. 1 substantially having a U-shape, in which body the forward shank 7*a* of the U, when the locking tongue is in introduced position, can snap in behind the front edge of a recess 8*a* of the locking tongue. The shank 7*a* of the locking body as well as its other shank 7*b* are led through the two guiding plates 4 in corresponding bores made in them and forming a sliding guide for the locking body. The web 9 of the locking body, connecting the two shanks 7*a* and 7*b*, in sidewise direction has projecting shoulders 9*a*, which in the embodiment shown are positioned in the same plane as the web 9, which in wedgelike manner is obliquely placed at a wedge angle $\alpha$ relative to the guiding plate 4. The free end portion of the plate spring 5 bears against the top side of the web and tends to maintain the locking body in downwards pressed condition in the position illustrated in FIG. 1. A wedge shaped nose 10, which projects downwardly into the path of introduction of the coupling tongue 8, is fastened to the front shank 7*a* of the locking body, the wedge surface of which nose in connection with the introduction of the coupling tongue 8 cooperates with the edge of the latter and thus tends to lift up the locking body against the bias of the plate spring 5. A fork shaped operating member which is displaceable along the guiding plate 4, is indicated with 11, and the legs 11*a* of this member are wedge shaped with a wedge angle $\alpha$ and extend below the shoulders 9*a* of the locking body. The front edges of the guiding plates 3 and 4 are inserted in a guiding body 12 preferably made of plastic material and intended to facilitate the guiding of the coupling tongue into the interspace between the guiding plates. An ejector member 13 occupies a position in the interspace between the guiding plates 3 and 4 and is provided with projections extending in longitudinal slits 14 in each one of the guiding plates in order to secure the desired movement of the ejector member in the longitudinal direction of the guiding plates. The ejector member 13 is spring loaded to the right according to the drawing by means of a helical spring 16, of which one end is held by a projection 13*a* of the ejector member, the other end resting against a stop near the point, where the guiding plates are fastened to the terminal ferrule 2. A housing, in which the device described above is enclosed, is indicated with 15. The operating member has an unobstructed pressure surface 11*b*, located at the front of the receiving part, and a guiding surface 11*c*, which is guided against the inside of the housing 15. By choosing the wedge angle $\alpha$ of the shank portions of the operating member in such a manner that it corresponds to the angle $\alpha$ of inclination of the web of the locking body in extended abutment is obtained between the locking body and the operating element, which results in a good guiding performance of the operating body, whereby the same is freed from laterally directed friction producing forces, when the operating member 11 is pressed in.

When introducing the coupling tongue 8 between the two guiding plates 4 and 3, which somewhat exceed the coupling tongue 8 in the thickness, the front terminal edge of the coupling tongue reaches contact with the nose 10, which during a continued introduction of the coupling tongue by means of a sliding co-operation with the latter lifts up the locking body 7, so that the front portion of the coupling tongue can pass the shank portion 7*a* of the locking body, whereafter it snaps down behind the stop edge shaped by the opening 8*a* of the coupling tongue. By dimensioning the length of the shank 7*b* of the locking body in such a manner that during the complete cycle of movement it travels through both the guiding plates 3 and 4, an additional good guiding performance is obtained by the locking body during its lifting movement. The ejector member 13 has such a shape that during the last portion of the introduction of the coupling tongue 8 it reaches contact against the coupling tongue and is carried along in the movement of the latter against bias of the spring 16. When one desired to disengage the coupling tongue 8, the operating organ 11 is pressed to the right, whereby a displacement between the outer wedge surface of the shanks of the operating member and the undersides 9*a* of the shoulders takes place without any friction producing tilting movement being given to the locking body, this thanks to the extended contact surface between the locking body and the operating member.

On account of the comparatively narrow nose 10 extending through longitudinal slits in the guiding plates 3, 4 a good lateral guiding of the locking body is in addition obtained.

The invention is not limited to the embodiment described above and illustrated in the drawing by way of example only, but the receiving part can be varied as to its details within the scope of the following claims without departing from the fundamental idea of the invention.

We claim:

1. A receiving part for a safety belt for vehicles, wherein the safety belt has a substantially disc-shaped coupling tongue, comprising: guiding plate means forming a space therebetween for receiving said coupling tongue, locking means in said receiving part and movable in a direction transverse to said guiding plate means to lock said tongue therebetween, a wedge-shaped operating member displaceable along at least one of said guiding plate means, said operating member having surface means forming a wedge angle with said guiding plate means and facing away therefrom, said locking means having a wedge-shaped portion with substantial surface areas extending parallel to and resting on said surface means of said operating member, and spring means biasing said locking means such that said areas engage said surface means of said operating member.

2. A receiving part, for a safety belt for vehicles, wherein the safety belt has a substantially disc-shaped coupling tongue, comprising: guiding plate means forming a space therebetween for receiving said coupling tongue, locking means in said receiving part and movable in a direction transverse to said guiding plate means to lock said tongue therebetween, a wedge-shaped operating member displaceable along at least one of said guiding plate means, said operating member having a surface which forms a wedge angle with said one guiding plate means and faces away therefrom, said locking means having means resting on said surface of said operating member with supporting or sliding surfaces extending in the direction of movement of said operating member, and spring means biasing said locking means such that said surfaces engage said surface of said operating member, said locking means comprising a locking body with an element of substantially U-shaped cross section in the direction of introduction of said coupling tongue, said element having two shank portions extending substantially at right angles to said guiding plate means, and a web portion bridging a portion of the outside of at least said one guiding plate means and supporting shoulders forming said means resting on said surface of said operating member, said shank portions being substantially parallel to each other and extending through openings in said guiding plate means, said shank portion positioned nearest to where said coupling tongue is introduced into said receiving part, engaging said coupling tongue.

3. A receiving part according to claim 2, wherein said locking body is made of a piece of bent sheet metal, said web portion and said shoulders being positioned in a common plane extending parallel to the surface of said operating member, which surface rests on said shoulders.

4. A receiving part according to claim 2, comprising a wedge-shaped nose portion supported by said shank portion for engaging said coupling tongue, said nose portion projecting into the path of introduction of the coupling tongue and being adapted, by sliding cooperation with the terminal edge of the tongue, to lift up the locking body out of the path of introduction against the bias of said spring means.

* * * * *